US005810578A

United States Patent [19]

Hystad et al.

[11] Patent Number: 5,810,578

[45] Date of Patent: Sep. 22, 1998

[54] DEVICE FOR BURNING GAS FROM A PRODUCTION PLANT FOR OIL OR GAS

[76] Inventors: Harald Hystad, deceased, late of Kopervik, Norway; by Anne Elise Hystad, legal representative, c/o Karmoy Winch AS, Postboks 160, 4251 Kopervik, Norway

[21] Appl. No.: 809,911

[22] PCT Filed: Oct. 2, 1995

[86] PCT No.: PCT/NO95/00175

§ 371 Date: Jun. 5, 1997

§ 102(e) Date: Jun. 5, 1997

[87] PCT Pub. No.: WO96/10719

PCT Pub. Date: Apr. 11, 1996

[30] Foreign Application Priority Data

Oct. 3, 1994 [NO] Norway ..... 943680

[51] Int. Cl.[6] ..... F23D 14/00

[52] U.S. Cl. ..... 431/202

[58] Field of Search ..... 431/202

[56] References Cited

U.S. PATENT DOCUMENTS 3,852,023 12/1974 Itoh et al. ..... 431/202
3,892,519 7/1975 Reed et al. .
3,915,620 10/1975 Reed .
4,128,389 12/1978 Straitz ..... 431/202
4,516,932 5/1985 Chaudot .

FOREIGN PATENT DOCUMENTS 1 533 731 11/1978 United Kingdom .

OTHER PUBLICATIONS

Patent Abstracts of Japan, vol. 13, No. 41, M–791, abstract of JP, A, 63–247526(Asia Sekiyu K.K.), 14 Oct. 1988 (14.10.88).

*Primary Examiner*—Carroll B. Dority
*Attorney, Agent, or Firm*—Hardaway Law Firm, P.A.

[57] ABSTRACT

A device for burning gas from a production plant for oil/gas comprising a burner at the top of a flare pipe (8). The production plant is connected to the flare pipe (8) through a low pressure collection line (1) for process gas. The device reduces combustion of valuable production gas to a minimum. To this end, the collection line (1) is connected to an expansion tank (2) having a return line (4) to the production plant and, downstream relative to the expansion tank (2), a liquid trap (6) has been disposed.

6 Claims, 3 Drawing Sheets

DEVICE FOR BURNING GAS FROM A PRODUCTION PLANT FOR OIL OR GAS

The invention relates to a device for burning gas in oil/gas production, wherein the production plant is assigned a burner through a low pressure collection conduit for process gas.

Gas escaping a production plant for oil/gas constitutes an explosion risk and is, consequently, burned before the combustion products are released into the atmosphere.

In order that sudden and unintentional discharges of gas could be burned in the burner, the latter has to be ignited at all times. This involves the necessity of supplying the burner with gas continuously.

Burning gas pollutes the atmosphere and gives an increased discharge of $CO_2$. Moreover, in order to maintain the permanent flame, one has to burn gas that otherwise might have been sold and it is, therefore, connected with substantial costs to keep the burner continuously in operation with a view to a possible future unintentional discharge of gas.

Consequently, the object of the invention has been to provide a device for burning gas in accordance with the introduction section, wherein burning of valuable production gas has been kept at a minimum level.

According to the invention, this object is realized through shaping and designing the device such that it exhibits the features appearing from the characterizing part of the following claim 1.

A process plant to which the device according to the invention should be assigned, is in known manner connected to a collection line for surplus gas. This collection line is assigned a tank (expansion tank) in which an underpressure is maintained, a compressor carrying surplus gas from the tank and back into the process. The tank is connected to a flare burner through a liquid trap preventing the compressor to suck false air.

Thus, according to an important feature of the invention, the burner is connected to an expansion tank through a liquid trap.

According to another important feature of the invention, the liquid trap is assigned a liquid reservoir and a level controller adapted to influence the liquid reservoir in order to replace possible loss of liquid in the liquid trap.

Advantageously, the liquid trap may be assigned a non-return valve adapted to prevent gas from penetrating into said liquid reservoir.

A flare pipe pot may be disposed downstream relative to the liquid trap, and said pot may be provided with at least one lateral guide/barrier plate preventing trap liquid from the liquid trap from being hurled up into the flare pipe leading to the burner which is located at the uppermost level.

Upon a sudden discharge of gas, the pressure within the expansion tank increases, whereupon liquid from the liquid trap is hurled up into said flare pipe pot and, thus, gives a free passage for gas to the burner.

According to a subordinate feature of the invention, the burner is continuously driven with pilot gas, such that a permanent pilot flame is being maintained. Thus, the burner is assigned a pilot gas reservoir for controlled supply of pilot gas to the burner. Such a controlled combustion of pilot gas represents only insignificant costs as compared with the excessive combustion of process gas taking place at known and conventional process plants, and which has been further accounted for introductorily.

Further objects, features and advantages of the invention appear from the following description of an examplary embodiment which is diagrammatically illustrated on the attached drawings, wherein.

Figure 1:
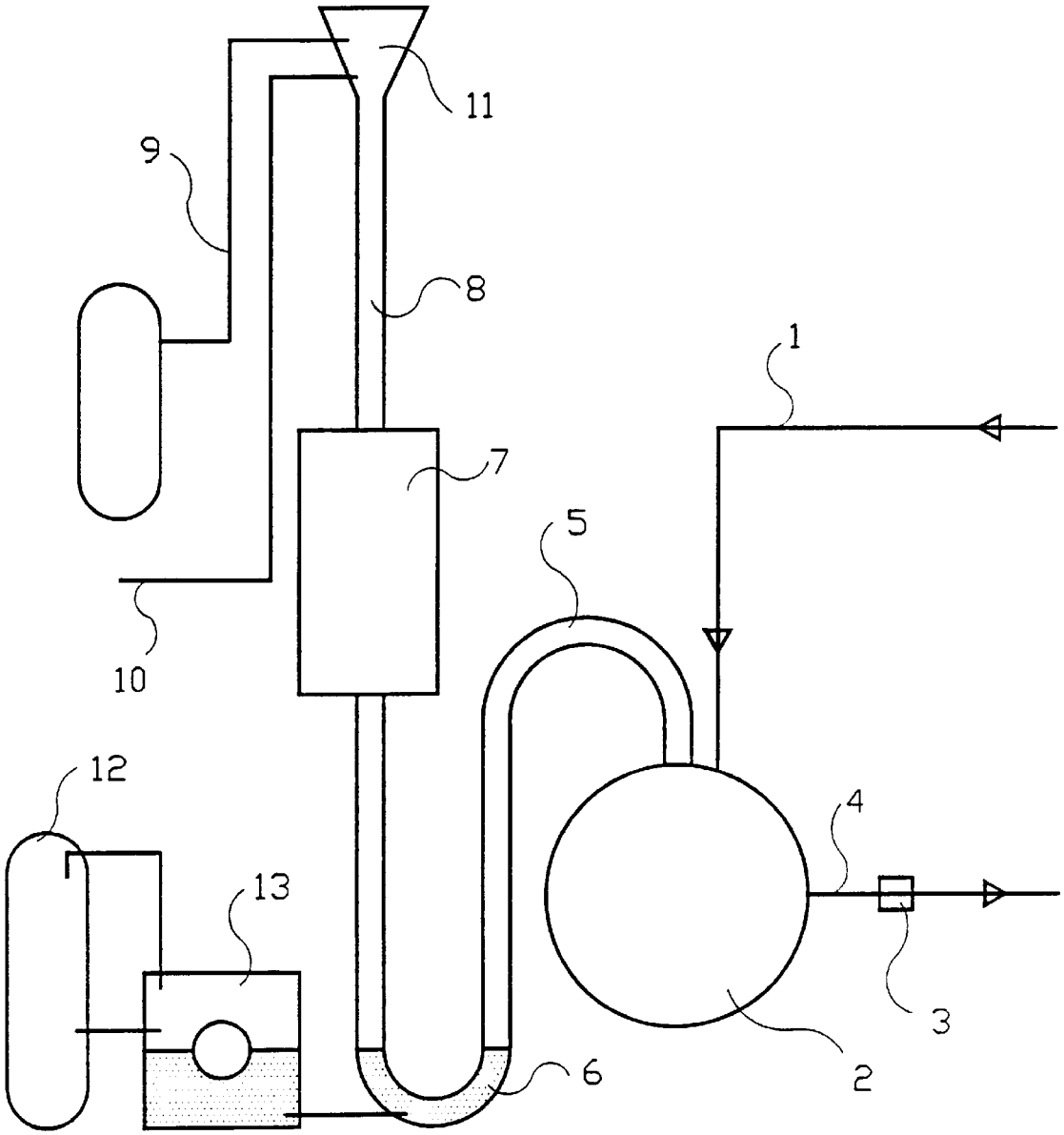
FIG. 1 shows the process plant's collection line and burner as well as intermediate equipment components in side elevational view/axial section.

In the drawings, FIG. 1, reference numeral 1 denotes a collection line for surplus gas and smaller gas discharges, assigned a process plant not further shown.

The collection line 1 leads to an expansion tank 2 (a tank which accommodating change of volume) operating at underpressure and which, to this end, is connected to a compressor 3 adapted to carry gas from the tank 2 back into the process again through a pipeline 4.

Through a short pipeline 5, the expansion tank 2 is connected to a liquid trap 6 which, at the downstream end thereof, is connected to a flare pipe pot 7. The flare pipe which uppermost carries a burner known per se (not further shown in FIG. 1), is generally denoted at reference numeral 8.

In order to maintain a permanent pilot flame which is independent on the supply of excess gas from the process plant, the burner is supplied with fuel gas and air through pipelines 9 and 10, respectively. The pilot burner at the top of the flare pipe 8 is assigned a cap in order to maintain good combustion conditions.

In order to replace possibly lost liquid trap liquid, a liquid reservoir 12 has been disposed, the liquid trap 6 being assigned a level controller 13 which is coupled to the liquid reservoir 12 for—upon falling liquid surface within the liquid trap 6—to cause the reservoir 12 to supply thereto an amount of liquid corresponding to the one lost.

Figure 2:
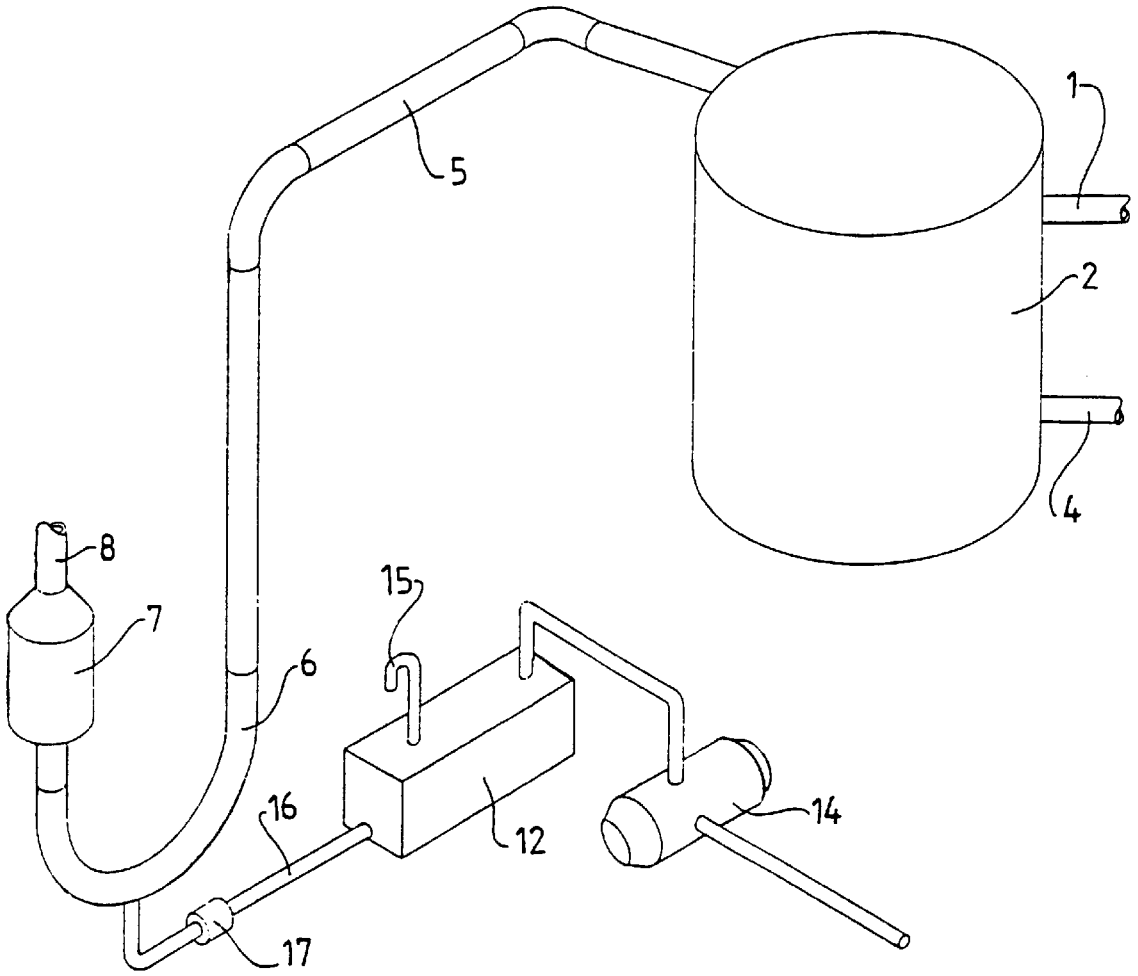
FIG. 2 shows in perspective the expansion tank and the flare pipe pot and intermediate components.

According to FIG. 2, the liquid reservoir 12 has been assigned a liquid pump 14 and a venting pipe 15, a non-return valve 17 being disposed in a connection line 16 between liquid reservoir 12 and liquid trap 6, and adapted to prevent gas from penetrating into the liquid reservoir 12.

Figure 3:
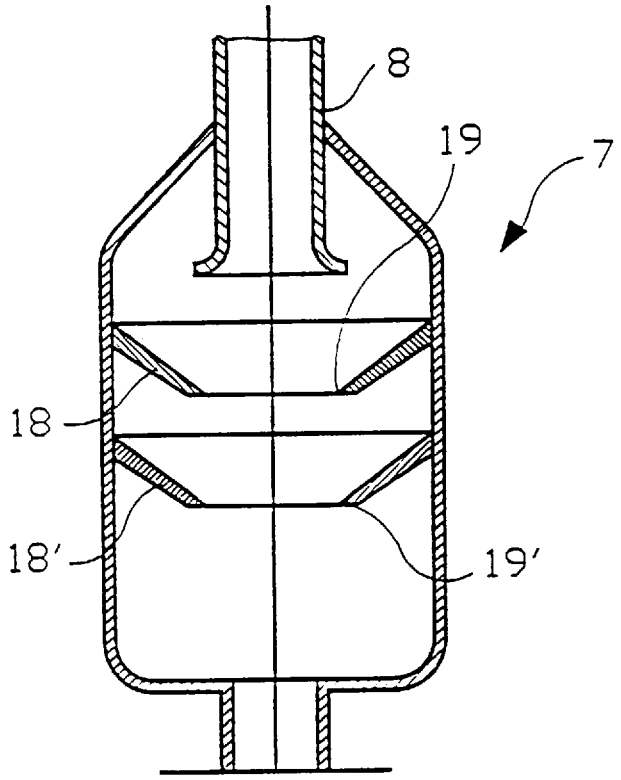
FIG. 3 shows a vertical cross-sectional view through the flare pipe pot separately.

In the example, in accordance with FIG. 3, the flare pipe pot 7 is equipped with two internal, parallel guide/barrier plates 18, 18', each having a through-going, central hole 19, 19'. The plates 18, 18' shall prevent liquid from being hurled up into the flare pipe 8 leading to the burner.

During normal operation, excess gas and smaller discharges of gas are conducted to the expansion tank 2 in order to have the pressure reduced. The compressor 3 carries gas from the tank 2 back into the process again through the pipeline 4. If the discharge is so large that the pressure within the expansion tank 2 exceeds a predetermined value given by the liquid column in the liquid trap 6, the liquid trap 6 opens, liquid being hurled up into the flare pipe pot 7, where the liquid is spread, so that gas may pass. When the pressure within and the gas flow through the expansion tank are reduced, liquid trap liquid from the flare pipe pot 7 will flow back into the liquid trap 6, which is formed by a downwardly convex pipe bend (6). A possible loss of liquid in the liquid trap 6, is replaced from the liquid reservoir 12 through the level controller 13.

It is claimed:

1. A device for burning gas from a production plant for oil/gas, comprising a flare burner at the top of a flare pipe (8), and wherein the production plant is connected to the flare pipe (8) through a low pressure line (1) for process gas, a liquid trap (6) being positioned between said production plant and said flare pipe (8), characterized in that the collection line (1) is connected to a tank (2) adapted to accommodate a varying amount of surplus gas generated through a change in the gas volume within said collection line (1), said tank (2) having a return line (4) to the production plant, said liquid trap (6) being positioned between said tank (2) and said flare pipe (8) to block low pressure gas from reaching said flare pipe and allowing high pressure gas to pass to said flare pipe.

2. A device as set forth in claim 1, characterized in that the liquid trap (6), which may contain an expedient liquid such as glycol-diesel, is formed from an upwardly concave pipe bend which, at one end thereof, is connected to a downwardly directed pipeline portion included in a pipeline between said tank (2) and said liquid trap (6) and which, at the other end thereof, is indirectly connected to the flare pipe (8).

3. A device as set forth in claim 1, characterized in that the liquid trap (6) is assigned a liquid reservoir (12) and a level controller (13) which, upon falling liquid level in the liquid trap (6), is adapted to influence the liquid reservoir (12) such that liquid lost is replaced through controlled liquid supply, and that the liquid trap (6) is assigned a non-return valve (17) preventing gas from penetrating into the liquid reservoir (12).

4. A device as set forth in claim 1, characterized in said tank (12) is assigned a compressor (3) adapted to carry excess gas from said tank (2) back into the production plant again, during which the compressor (3) maintains a desired underpressure in said tank (2), and that the flare burner at the top of the flare pipe (8) is assigned a separate fuel supply (9) for the maintenance of a permanent pilot flame in a condition of readiness, in which the burner at any time is ready to take charge of and burn sudden and unintentional discharges of gas from the production plant.

5. A device as set forth in claim 1, characterized in that the liquid trap (6) downstream thereof is connected to a flare pipe pot (7) which is coupled to the bottom end of the flare pipe (8).

6. A device as set forth in claim 5, characterized in that internally the flare pipe pot (7) has at least one guide/barrier plate (18, 18') with a vertically through-going aperture (19, 19').

* * * * *